US007878273B2

(12) United States Patent
Wilde et al.

(10) Patent No.: US 7,878,273 B2
(45) Date of Patent: Feb. 1, 2011

(54) ULTRA-HARD DRILLING STABILIZER

(75) Inventors: David Wilde, Houston, TX (US); James Shamburger, Spring, TX (US)

(73) Assignee: Omni IP Ltd., Road Town, Tortola (VG)

( * ) Notice: Subject to any disclaimer, the term of this patent is extended or adjusted under 35 U.S.C. 154(b) by 0 days.

(21) Appl. No.: 12/313,130

(22) Filed: Nov. 17, 2008

(65) Prior Publication Data

US 2010/0122851 A1 May 20, 2010

(51) Int. Cl.
*E21B 17/10* (2006.01)

(52) U.S. Cl. ..... 175/325.2; 166/241.1

(58) Field of Classification Search ..... 175/325.1, 175/325.2, 399, 425; 166/241.1, 241.2
See application file for complete search history.

(56) References Cited

U.S. PATENT DOCUMENTS 3,250,578 A * 5/1966 Lubbes ..... 175/325.2
3,285,678 A * 11/1966 Garrett et al. ..... 175/325.2
3,419,094 A * 12/1968 Bobo ..... 175/325.2
3,420,323 A * 1/1969 Owens ..... 175/323
3,645,587 A * 2/1972 Parker ..... 175/325.1
4,277,108 A * 7/1981 Wallace ..... 175/325.1
4,396,234 A * 8/1983 Garrett ..... 175/325.2
4,558,753 A * 12/1985 Barr ..... 175/431
4,682,987 A * 7/1987 Brady et al. ..... 51/293
4,729,438 A * 3/1988 Walker et al. ..... 175/76
6,117,493 A * 9/2000 North ..... 427/419.7
6,138,780 A * 10/2000 Beuershausen ..... 175/408
6,401,820 B1 * 6/2002 Kirk et al. ..... 166/311
7,398,840 B2 * 7/2008 Ladi et al. ..... 175/425
2004/0245024 A1 * 12/2004 Kembaiyan ..... 175/425

FOREIGN PATENT DOCUMENTS

WO WO 9325794 A1 * 12/1993

* cited by examiner

*Primary Examiner*—David J Bagnell
*Assistant Examiner*—Blake Michener
(74) *Attorney, Agent, or Firm*—The Matthews Firm

(57) ABSTRACT

A drilling stabilizer having a body and a plurality of blades integrally cast from tungsten carbide particles bound together with a heated metal binder, for use in drilling oil and gas wells, has a first box end and a second pin end at the distal end of the stabilizer. A plurality a PDC cutters are mounted on the top end of the stabilizer to allow the stabilizer to be used as a reamer when pulling the stabilizer out of the borehole. A steel tube is formed within the interior of the stabilizer in the molding process and which allows the pin end to have steel threads and the box end to also have steel threads to facilitate the makeup of the stabilizer with either the steel threads of a drill bit or the steel threads of joints of drill pipe.

16 Claims, 3 Drawing Sheets

ULTRA-HARD DRILLING STABILIZER

FIELD OF THE INVENTION

The present invention relates, generally, to drill string stabilizers placed in drill strings used in earth boring operations, and in particular, to drilling stabilizers having ultra-hard bodies with ultra-hard ribs whose surfaces are in constant contact with the borehole wall to provide stabilization and to prevent azimuthal deviation.

BACKGROUND OF THE INVENTION

It is well known in the art of drilling oil and gas wells, to place stabilizers in the string of drill pipe, above the drill bit. These stabilization tools employ two basic methods of maintaining the orientation of the drill bit about its axis and ideally, also the drill string axis of rotation. Such tools minimize drift of the borehole from the vertical or any other preferred azimuthal angle. The first method is tool rigidity itself and the second method is to contact the well bore wall. Inasmuch as continual circulation of drilling fluid down through the inner bore of the drill string and returning up through the annular area between the drill string and the bore hole wall must be maintained, the second method of stabilization is most usually obtained through the use of "ribs," "ridges" or "blades" which protrude out from the main body of the tool in contact with the bore hole wall. The interstitial area between these blades provides the annular area or volume necessary for return of circulating fluid used in rotary drilling operations.

The bodies of the conventional stabilizer, as well as the ribs or blades, are typically manufactured from mild steel. Because the tool's rib surfaces are in constant contact with the borehole wall to provide maximum stabilization and prevent azimuthal deviation, these ribs in the prior art are provided with protection against the erosion and abrasion effected by hard abrasive geologic formations. If not protected by hard metal stripping or insertion of ultra-hard material into the mild carbon steel, the contacting surface will abrade and the tool will progressively lose its effectiveness. Use of such inserts in such a tool is disclosed, for example, in U.S. Pat. No. 4,304,311 and U.S. Pat. No. 4,156,374.

The present invention is a marked improvement over the use of ultra-hard inserts, buttons or pads used with the mild steel bodies and ribs known in the stabilizer arts.

Since the 1950's, powdered metal infiltration casting has been used to manufacture drill bits. In the 1950's through the 1970's, natural diamond bits were manufactured with this process. It is common practice today to manufacture PDC bits with this same process, inherited from the natural diamond bits.

The present invention uses powdered metal infiltration casting to manufacture a drill string stabilizer whose primary function is to stabilize the drill string centrally within a previously drilled hole. In manufacture, the stabilizer does resemble a reaming tool in that it requires both an upper and lower oilfield connection. But the primary purpose of this tool is stabilization, and the reason for this method of manufacture is to produce a more wear resistant body by using tungsten carbide as the primary metallic element in the stabilizer blades and body.

By manufacturing the contact surfaces of infiltrated tungsten carbide, the predominant element in the contact zones is tungsten carbide, which is more resistant to wear, and thus maintains the outer diameter of the stabilizer for far longer than steel. This results in a stabilizer which is more robust than the current standard, steel.

Additionally, the technology used in drill bits to retain outside diameter can be utilized in a stabilizer. This includes the capacity to place PDC wear elements in the contact zones, as well as thermally stable PDC elements, tungsten carbide tiles, natural diamonds and similar ultra-hard materials. New technology within the drill bit industry allows for infiltrated tungsten carbide (referred to hereafter as matrix) to be repaired by welding and brazing with specialized metallic compounds.

DETAILED DESCRIPTION OF THE PREFERRED EMBODIMENTS

Figure 1:
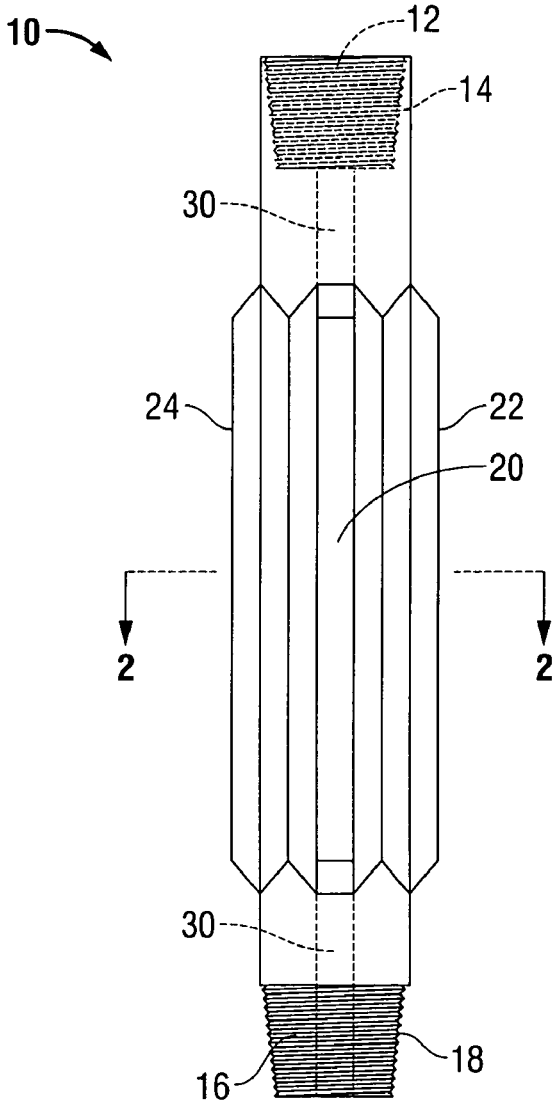
FIG. 1 is an elevated view of a drilling stabilizer according to the present invention.

Referring now to the drawings in more detail, FIG. 1 illustrates a four bladed drilling stabilizer 10 having a box (female), first end 12 having internal threads 14 into which the pin end (not illustrated) of a joint of drill pipe can be threadedly attached. A pin end (male), second end 16 is illustrated at the distal end of the drilling stabilizer 10. The pin end 16 has male threads 18 for threadedly connecting with the box end of a second joint of drill pipe (not illustrated).

Figure 2:
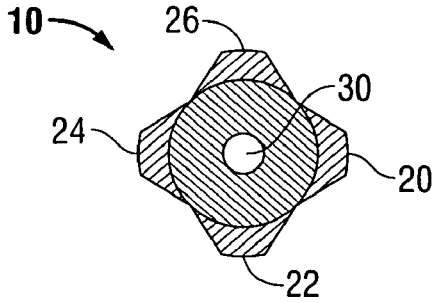
FIG. 2 is a sectional, top plan view of the drilling stabilizer according to the present invention, taken along the sectional lines 2-2 of FIG. 1.

As illustrated in FIGS. 1 and 2, the drilling stabilizer 10 has four blades (ribs) 20, 22, 24 and 26. The drilling stabilizer 10 has a central passageway 30 running along the entire length of stabilizer 10, from end 12 to end 16, through which drilling fluid may be pumped, all as is known in the art. Although the embodiment of FIGS. 1 and 2 illustrates a stabilizer having four blades or ribs, the invention contemplates a plurality of blades, which can be two, three, four, five or any number of such blades.

An important feature of the present invention resides in the fact that by manufacturing the body and the blades from silicon carbide matrix material, the ferrous content of the stabilizer, normally present in steel stabilizers, is greatly reduced, and while not making the stabilizer to be completely non-magnetic, does cause the stabilizer to be less magnetic, a highly desirable feature when conducting measurement-while-drilling (MWD) operations.

In the manufacture of a drilling stabilizer, according to the present invention, the manufactured product comprises a body and the blades each manufactured as a tungsten carbide matrix. In the matrix casting industry, essentially the only limitation on the length of the finished product is the length of commercially available furnaces. Otherwise, the stabilizer can be as long as, or as short as desired, but the furnaces which are currently available would only allow the end product to be about fifteen (15) feet long.

Figure 3:
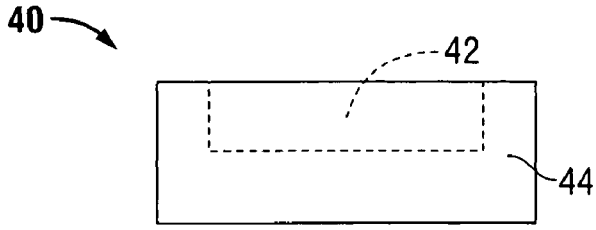
FIG. 3 is a block diagram, schematic view of a mold complex used for molding a tungsten carbide drilling stabilizer according to the invention.

FIG. 3 illustrates a highly engineered graphite or other ceramic mold 42 is used in a container 44, together being a mold complex 40 for casting the drilling stabilizer 10, including its body and blades, as a tungsten carbide matrix. In one embodiment, the cast product will have one or both of the ends 12 and 16, having female and male threads, respectively, while a second embodiment will have the threaded ends 12 and 16, but achieved through the use of steel connections. The mold 42 will be contoured to produce either the embodiment of FIGS. 1 and 2, or will be contoured through the use of steel inserts in the threaded ends 12 and 16.

The mold complex 40 is filled with powdered, crushed or otherwise processed tungsten carbide particles, together with a binding metal such as nickel, copper or various other metals alloyed to produce various characteristics. The mold complex 40 is placed in a furnace, which causes the binding metal to melt and infiltrate the spaces between the tungsten carbide particles.

If the embodiment is used which molds one or both of the threaded ends 12 and 16, the binding material will preferably comprise a ferrous alloy to facilitate the makeup of the one or both ends with the threaded steel ends of the drill pipe being joined with the drilling stabilizer. In another embodiment, a steel form is placed centrally within the mold 42. The purpose of the steel blank is to allow a ferrous threaded connection to be attached to the drilling stabilizer after the stabilizer has been cast in a furnace, which otherwise has to address the extreme difficulty in machining tungsten carbide.

Thus there has been illustrated and described herein a method and apparatus for using powder metal infiltration to cast a drilling stabilizer, thereby providing a more wear resistant body and the blades themselves. This drilling stabilizer is far superior to steel stabilizers having tungsten carbide inserts, buttons, pads or the like, because with those types of stabilizers, having tungsten carbide inserts in steel pads, the steel tends to wear out much more rapidly than the tungsten carbide parts, resulting in repair jobs to repair the steel components. Such repairs require a highly trained technical, and oftentimes the removal of the tungsten carbide components.

Figure 4:
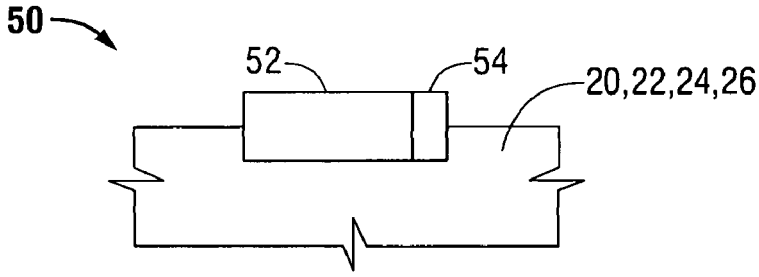
FIG. 4 is a partial view of a PDC cutter mounted, in an alternative embodiment, in one of the tungsten carbide blades according to the invention.
Figure 5:
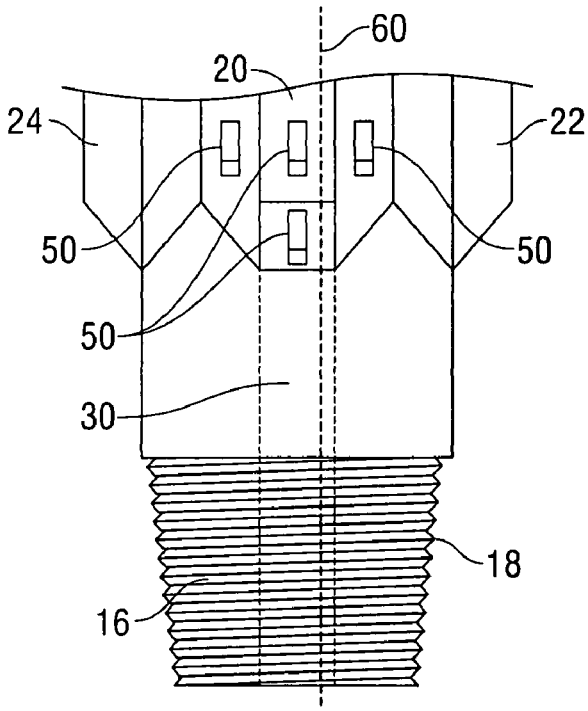
FIG. 5 is an elevated, cut away view of the top end of the drilling stabilizer illustrated in FIGS. 1 and 2, modified to include PDC cutters mounted in the tungsten carbide blades to allow upward reaming of earth boreholes.

Referring now to FIGS. 4 and 5, there is illustrated an alternative embodiment of the drilling stabilizer of FIGS. 1 and 2 which can utilize the tungsten carbide stabilizer 10 as an upward reamer. FIG. 4 illustrates a polycrystalline diamond compact (PDC) cutter having a substrate 52 which is itself ultra-hard, for example, made from tungsten carbide, and a cutting structure 54 having a plurality of partially bonded, super hard diamond or diamond-like crystals, and catalyzing material, typically cobalt. The PDC cutter is secured within the blade (20, 22, 24, 26) by well-known brazing techniques, or any other technique commonly used in securing PDC cutters in matrix body drill bits.

FIG. 5 illustrates the top end 18 of the tungsten carbide drilling stabilizer 10 illustrated in FIGS. 1 and 2, modified with the inclusion of a plurality of PDC cutters 50. The cutters 50 can be mounted in the blades (20, 22, 24, 26) in any number desired, with any rake angle desired, and oriented at any angle desired. As illustrated in FIG. 5, the cutters 50 are oriented to be aligned parallel to the longitudinal axis 60 of the stabilizer 10, but can be aligned perpendicular to the axis 60, or at any other angle as desired. When reaming upwards, the drill string, including the stabilizer, as is always done in a drilling operation to prevent the joint of a drill string from being unthreaded, is always rotated to the right.

Consequently, the stabilizer can be designed for upwards reaming simply by placing PDC cutting elements in a position on the upper portion of the stabilizer blades. This is of benefit in directional wells where reaming upwards can remove key seats and doglegs, which traditionally require separate and discrete tools and operations.

Various matrix alloys may be employed in order to both improve wear resistance and "soften" the inherent hardness of traditional matrix used in drill bits. Logically, by varying the tungsten carbide grain sizes and distributions, as well as the binding alloys and their mixtures, many different metallurgical characteristics can be imparted to the matrix material.

By utilizing PDC wear elements mounted in the matrix blades, friction is reduced by having a harder and more dense material as the contact surface, reducing the drag coefficient when the contact zone slides across rock.

Figure 6:
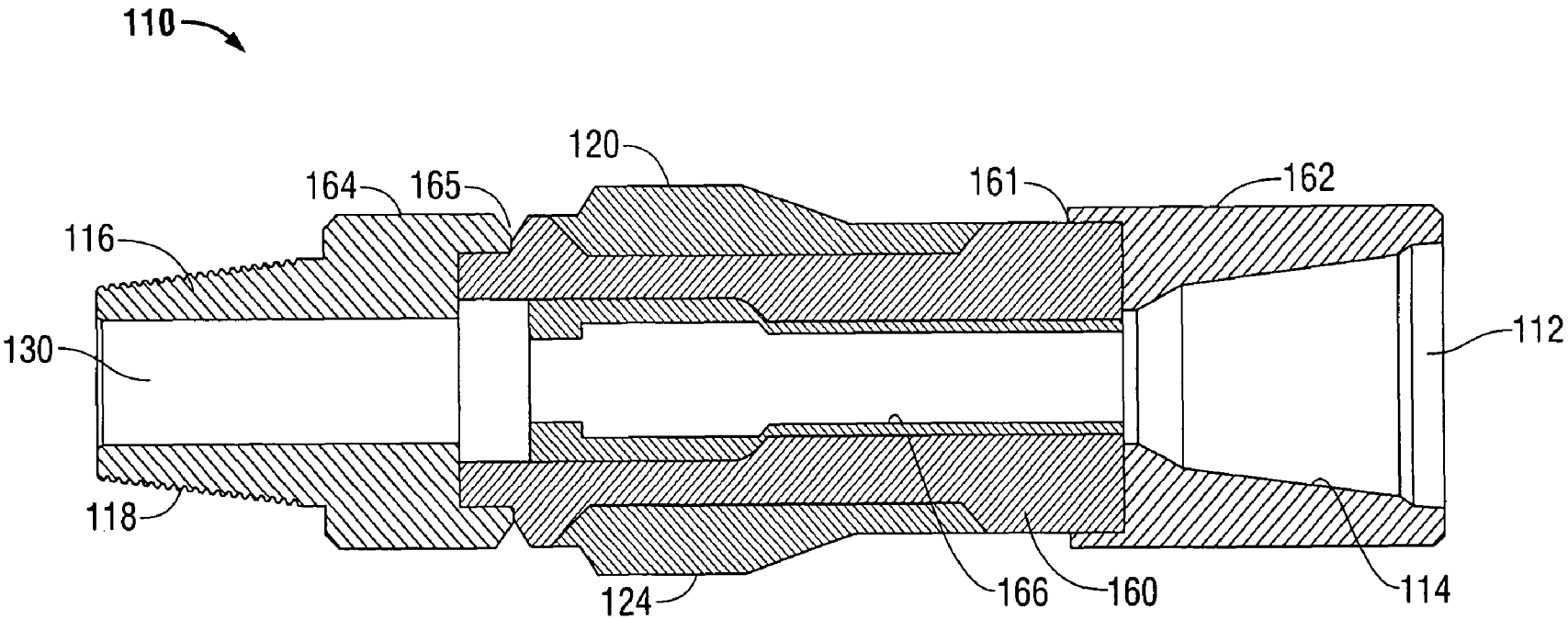
FIG. 6 is a side view, partially in cross-section, of a silicon carbide drilling stabilizer having a steel box end and a steel pin end according to the invention.

In another embodiment, the basal tubular element 160 in FIG. 6 is super-cooled to reduce its diameter. It is then inserted into a matrix laded body and allowed to return to ambient temperature. The resulting expansion of the basal tubular element against the internal diameter of the matrix stabilizer body mechanically locks it to the basal member. As drilling into the earth, one encounters only higher temperature regimes, the resulting mechanical lock is very effective.

Referring further to the embodiment illustrated in FIG. 6, the box end 112, having female threads 114 with its steel body 162 is welded at spot weld 161 to one end of the steel tube 160. The pin end 116, having male threads 118, including its steel body 164 is welded at spot weld 165 to the distal end of the steel tube 160, but the welding of the steel tube 160 to the ends 112 and 116 occurs after the east of the matrix body 166, including the matrix blades 120 and 124. The matrix body at least partially engulfs the steel tube to maintain in place all the components of the drilling stabilizer.

It should be appreciated that the numbering system used with respect to FIG. 6 is essentially identical to the numbering system used in FIGS. 1 and 2 other than the addition of the numeral 1 in front of the numbers used in FIGS. 1 and 2, e.g., "12" in FIG. 1 and "112" in FIG. 6.

The invention claimed is:

1. A drilling stabilizer comprising:

a tungsten carbide matrix body having a first end, a second end, and a longitudinal bore extending from the first end to the second end, wherein the tungsten carbide matrix body is formed substantially entirely from a matrix of tungsten carbide and one or more metal alloys;

a plurality of tungsten carbide matrix blades integrally formed with said tungsten carbide matrix body and formed substantially entirely from the matrix of tungsten carbide and one or more metal alloys; and a metal tube disposed within the longitudinal bore, wherein the metal tube comprises a first connection disposed at the first end, a second connection disposed at the second end, and bore extending from the first connection to the second connection, wherein the tungsten carbide matrix body is adapted for withstanding compressive longitudinal forces along the axis, and wherein the metal tube is adapted for withstanding tensile forces along the axis.

2. The drilling stabilizer according to claim 1, wherein said matrix body and said matrix blades are formed in a graphite mold from tungsten carbide particles and a metal binder heated to allow the molten binder to flow into the interstitial spaces between the tungsten carbide particles.

3. The drilling stabilizer according to claim 1, wherein the first connection comprises a threaded box end and the second connection comprises a threaded pin end.

4. The drilling stabilizer according to claim 3, wherein the metal tube comprises a steel tube positioned within the interior of said body, with the box end and the pin end being at the opposite ends of said tube.

5. The drilling stabilizer according to claim 4, wherein said steel tube is super-cooled prior to being inserted within the interior of said body, and then allowed to warm up and thereby expand to cause the steel tube to be locked in place within the interior of said body.

6. The drilling stabilizer according to claim 1, comprising in addition thereto, a plurality of PDC cutters mounted on at least one of said blades to allow said stabilizer to be used to ream upwardly as the stabilizer is being pulled upwards in an earth borehole.

7. A drilling stabilizer, comprising:

a body formed substantially entirely from a matrix material comprising particles of tungsten carbide and at least one metal alloy, wherein the body comprises a plurality of blades extending therefrom and integral therewith, wherein the plurality of blades are formed substantially entirely from the matrix material, and wherein the body is adapted for withstanding compressive forces;

a bore extending longitudinally through the body; and a metal tube disposed within the bore, wherein the metal tube comprises a length greater than the length of the body, thereby defining a first end and a second end, wherein the first end and the second end comprise threaded connections for engaging adjacent components, and wherein the metal tube is adapted for withstanding tensile forces.

8. The drilling stabilizer of claim 7, further comprising at least one cutter element mounted on at least one of the blades to enable the drilling stabilizer to be used to ream as the drilling stabilizer is pulled through a borehole.

9. The drilling stabilizer of claim 7, wherein the threaded connections comprise a first male threaded connection at the first end and a second male threaded connection at the second end.

10. The drilling stabilizer of claim 7, wherein the threaded connections comprise a first female threaded connection at the first end and a second female threaded connection at the second end.

11. The drilling stabilizer of claim 7, wherein the threaded connections comprise a male threaded connection at the first end and a female threaded connection at the second end.

12. The drilling stabilizer of claim 7, wherein the threaded connections comprise a female threaded connection at the first end and a male threaded connection at the second end.

13. A drilling stabilizer produced by a powdered metal infiltration casting process comprising the steps of:

providing particles of tungsten carbide into a mold comprising a void having the shape of a drilling stabilizer body with a plurality of blades extending therefrom;

providing into the mold a metal rod or a metal tube having a bore filled with a solid material;

providing at least one binding metal in fluid communication with the mold;

heating the mold, the particles, and said at least one binding metal, wherein said at least one binding metal is melted and flows into spaces between the particles of tungsten carbide to form a tungsten carbide matrix material;

permitting the tungsten carbide matrix material to cool to form a drilling stabilizer body with a plurality of blades extending therefrom disposed within the void of the mold, wherein the drilling stabilizer body is adapted to resist compressive forces;

removing the drilling stabilizer body with the plurality of blades extending therefrom from the mold; and providing a bore through the metal rod or the metal tube, wherein the metal tube is adapted to resist tensile forces.

14. The drilling stabilizer of claim 13, wherein the metal rod or metal tube is positioned within the void such that heating of the mold and said at least one binding metal and permitting the tungsten carbide matrix material to cool defines a space for providing a longitudinal bore through the drilling stabilizer body, wherein the metal rod or metal tube comprises a length greater than the length of the drilling stabilizer body, and wherein the metal rod or metal tube is provided with threaded connections for engaging adjacent components.

15. The drilling stabilizer of claim 13, wherein at least one cutter element is provided to at least one of the blades to enable the drilling stabilizer to be used to ream as the drilling stabilizer is pulled through a borehole.

16. The drilling stabilizer of claim 13, wherein the drilling stabilizer is provided with a length less than or equal to fifteen feet.

* * * * *